United States Patent [19]

Ehler

[11] 4,142,438

[45] Mar. 6, 1979

[54] MOUNT FOR HARMONICA REED OR THE LIKE

[75] Inventor: Martin Ehler, Trossingen, Fed. Rep. of Germany

[73] Assignee: Matth. Hohner AG, Trossingen, Fed. Rep. of Germany

[21] Appl. No.: 883,048

[22] Filed: Mar. 3, 1978

[30] Foreign Application Priority Data

Mar. 5, 1977 [DE] Fed. Rep. of Germany ..... 7706803
Mar. 8, 1977 [CH] Switzerland ..... 00284/77

[51] Int. Cl.[2] ..... G10B 3/00

[52] U.S. Cl. ..... 84/360; 84/375; 84/376 R

[58] Field of Search ..... 84/360–364, 84/375, 376 R

[56] References Cited

U.S. PATENT DOCUMENTS

| | | | |
|---|---|---|---|
| 373,118 | 11/1887 | Wood | 84/363 |
| 2,696,136 | 12/1954 | Rumonoski | 84/360 |
| 2,911,870 | 11/1959 | Bauer | 84/360 X |

*Primary Examiner*—Lawrence R. Franklin

*Attorney, Agent, or Firm*—Karl F. Ross

[57] ABSTRACT

A reed for a harmonica or the like has a free end portion that is adapted to vibrate and give a predetermined tone and a T-shaped mounting end portion substantially the same width as the free end portion and having a pair of laterally projecting tabs. A reed support plate is formed with a pair of transversely spaced and longitudinally extending edge portions that form with a pair of longitudinally spaced and transversely extending web portions a window having a width generally equal to the reed width. A groove is formed at one of the edge portions and opens at the substantially planar face of the mounting plate. This groove extends transversely from the window and has a groove width substantially equal to the reed width, while a substantially planar base surface of the groove is inclined away from the window to the face. A rivet integrally formed with the plate extends through a correspondingly dimensioned hole in the mounting portion of the reed so that the mounting portion of the reed can be positioned in the groove and the rivet can be upset to hold the entire reed tightly in place with the free end portion in registration over the window.

15 Claims, 7 Drawing Figures

MOUNT FOR HARMONICA REED OR THE LIKE

FIELD OF THE INVENTION

The present invention relates to the mounting of a reed in an instrument such as a harmonica, accordion, concertina, or the like.

BACKGROUND OF THE INVENTION

A reed-type wind instrument, such as a harmonica, reed organ, concertina, accordion, or the like, has a plurality of normally metallic reeds each having a mounting portion fixed on a support plate and a free end portion extending over and registering with a window formed in the support plate. Each such free end portion is constituted and dimensioned so that when a stream of air passes around the respective free end portion and through the respective window this free end portion vibrates at a particular frequency and thereby produces a particular respective musical note. The tone quality is determined by various factors, in particular by the orientation of the free end portion of the reed relative to its respective window and the mounting of the reed on the mounting plate.

Thus over the years various techniques have been developed for mounting the reeds on the mounting plate. As it is essential that the mounting portion be rigidly connected to the mounting plate, recourse has usually been had to the use of rivets which are capable of forming a virtually unitary connection that is not loosened by vibration. The fastening is therefore normally done by a highly qualified worker who meticulously positions each reed at the respective window, leaving a small gap of at most a few hundredths of a millimeter around each free end portion and the respective window. The rivet is then carefully positioned and upset, and afterward the item is normally examined and tested carefully to establish that each reed is properly mounted. Even the slightest deviation from a relatively narrow range of tolerances can often deleteriously affect the tone quality emitted, cause the generation of undesired harmonics, or otherwise make the particular instrument unsuitable for use.

For these reasons the production of a high-quality reed-type wind instrument normally makes this instrument very expensive. Only highly qualified and well-trained personnel can be used to mount the reeds in position, so that labor costs are elevated, in particular because each such reed instrument has a multiplicity of such reeds. The production cannot readily be turned over to a worker who has not been carefully trained.

OBJECTS OF THE INVENTION

It is therefore an object of the present invention to provide an improved mounting for a reed of a wind instrument.

Another object is to provide an improved mounting for a reed of a harmonica, concertina, accordion, or the like.

Yet another object is to provide such a mounting which is so simple that it allows even relatively untrained personnel to assemble this delicate part of a musical instrument.

A further object of this invention is the provision of such a mount which is extremely rigid and which is set up so that the reed will be firmly held in a rigidly defined position relative to the respective window.

SUMMARY OF THE INVENTION

These objects are attained according to the present invention in a system wherein the reed support plate is formed with a pair of transversely spaced and longitudinally extending edge portions that form with two longitudinally spaced and transversely extending web portions a window of a window width generally equal to the reed width which is generally the same at the free end portion and mounting end portion of the flat reed. This reed support plate has a substantially planar face and is formed with a groove extending transversely from the window at one of the edge portions and having a groove width which is substantially equal to the reed width. In addition this groove has a substantially planar base surface which is inclined away from the window to the face, that is which is shallower adjacent the window than remote therefrom. Means, normally in the form of a rivet, is provided for securing the mounting portion in the groove on the base surface thereof so that the free end portion lies in direct registration over the window and is spaced remote from the mounting end portion above the face due to the inclination of the base surface of the groove relative to the face.

With the system according to the invention the mounting portion of the reed need merely be fitted into its groove so as to assure an exact positioning of this reed over its window. The two sides of the groove according to this invention are directly in line and coplanar with the sides of the window so that positioning of the reed directly parallel to its window, which positioning is often the hardest part of the assembly operation, is ensured.

According to further features of this invention the mounting portion of the reed is provided with a pair of oppositely projecting tabs that extend longitudinally of the mounting plate and this plate is formed with a recess that snugly receives these tabs. Thus in the completed assembly the mounting portion and these tabs will be at least partially recessed below the face of the mounting plate so that the reed can only lie in one position on the plate. This position is in turn determined by the accuracy of the molding, stamping, and/or machining operation used to form the plate and/or the reed. It is well known that it is possible in such operations to impart to a workpiece extremely exact tolerances, even at a relatively low unit cost.

Furthermore according to this invention the securing means is constituted as a rivet which extends substantially perpendicularly to the base of the groove and is of a diameter at least equal to the diameter of a throughgoing attachment hole. This rivet must be forced through the hole in the mounting portion and thereafter upset. The result is a vibration-proof coupling of the mounting portion on the mounting plate, with the flat planar lower surface of the mounting portion lying in surface contact on the correspondingly flat planar surface of the base of the groove. At the same time all of the planar edge surfaces of the mounting portion are in snug surface-to-surface contact with corresponding planar edge surfaces of the recesses receiving the tab and the groove receiving the body of the mounting portion. The reed is therefore fitted like a hand into a glove into the correspondingly shaped formation on the mounting plate, and the rivet is upset to form a permanent and rigid connection between the mounting portion and the mounting plate.

According to further features of this invention the recesses which receive the tabs at the rear end of the mounting portion may be formed as individual rectangular recesses each receiving a respective complementarily shaped rectangular tab. It is also within the scope of this invention to form the entire mounting plate with a longitudinally extending groove that constitutes all of the recesses for a plurality of reeds. Thus each of the T-shaped reeds will be fitted into a respective groove and will have the tabs of its rear end fit into the longitudinally extending recess. In order to prevent the generation of unwanted harmonics the transverse dimension of the longitudinally extending edge portion of the mounting plate between the end of the mounting portion and the corresponding longitudinal edge is substantially greater than the transverse dimension of the recess receiving the tabs. Such formation of the mounting plate ensures perfect longitudinal and transverse positioning of the reed on the mounting plate. The provision of a relatively short rivet formed unitarily with the mounting plate and extending merely slightly through the reed further ensures that the reed can only be secured to the mounting plate when it is in the exact required position.

SPECIFIC DESCRIPTION

Figure 1:
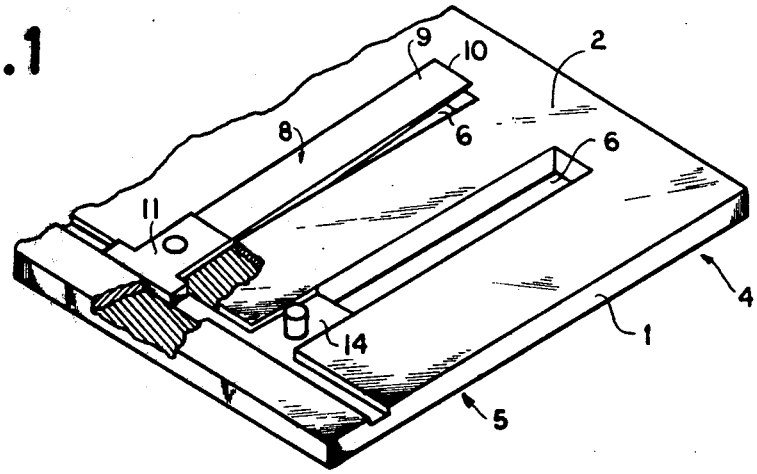
FIG. 1 is a partly broken away perspective view of the assembly according to this invention.

As shown in FIGS. 1-6 of the drawing the invention is basically comprised of two parts: a mounting plate 1 formed by a firm longitudinal edge portion 4, a rear longitudinal edge portion 5, and a plurality of transversely extending webs 2 defining rectangular windows 6, and of a reed 8 having a free end 9 with an unattached tip 10 and a mounting portion 11. The mounting plate 1 is formed as a single unitary piece by molding and/or stamping, and the reed 8 is formed of a single unitary piece of carefully machined spring steel.

Figure 2:
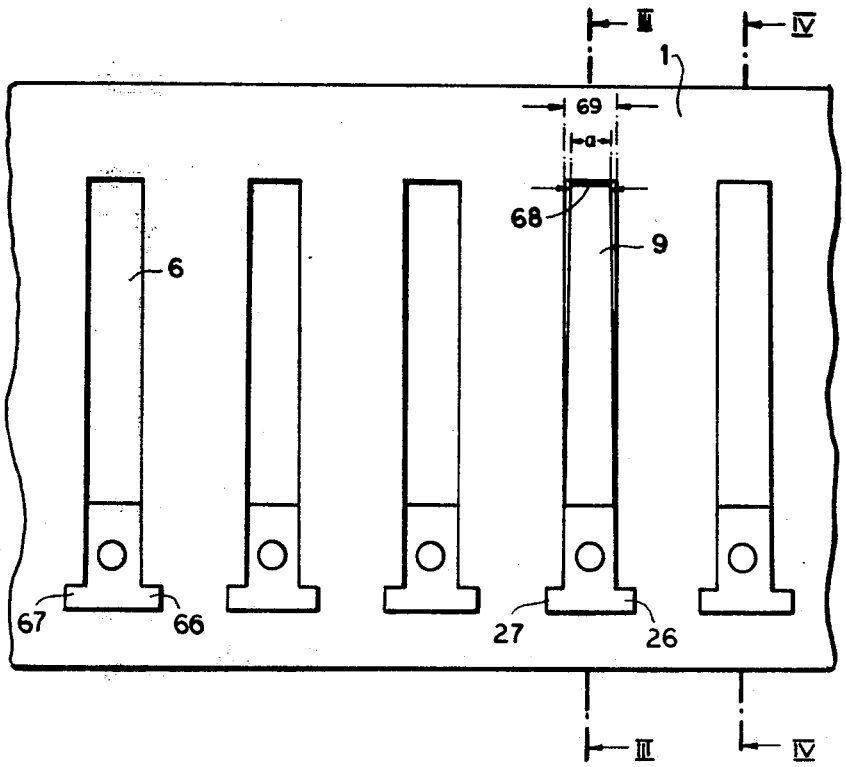
FIG. 2 is a plan view of a modified reed assembly in accordance with this invention.
Figure 4:
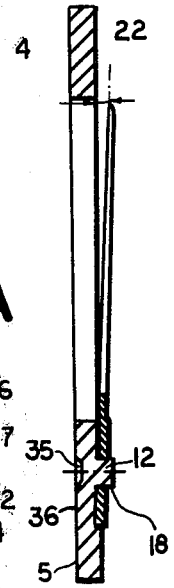
FIG. 4 is a section taken along line IV—IV of FIG. 2.
Figure 5:
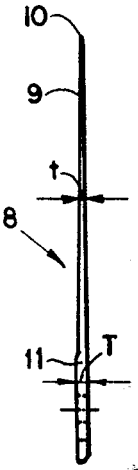
FIGS. 5 and 6 are side and top views, respectively, of the reed according to this invention.
Figure 6:
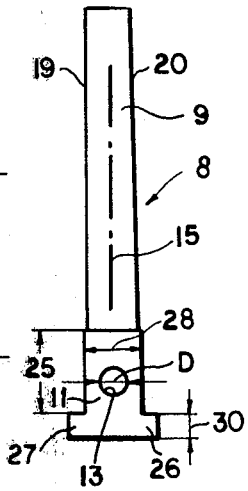

The reed 8 as best shown in FIGS. 2, 5 and 6 is generally T-shaped. The central leg of the T is constituted as the vibratable free end portion 9 and is of a gently tapering thickness t which at its greatest is smaller than the thickness T of the mounting portion. In addition the free end portion 9 tapers slightly from the width 28 of the mounting portion 11 to a width 68 which is slightly smaller than the width 69 of the window 6. Thus the two longitudinal edges 19 and 20 of the blade or tongue forming the free end 9 of the reed 8 form an angle a of less than 5° to each other. The exact shape of the free end portion is determined in a manner well-known in the art. For the purposes of the invention, therefore, the exact formation and shape of the vibrating portion 9 of the reed 8 will not be gone into in great detail, and this portion 9 will be considered to be of generally regular width and thickness.

The mounting portion 11 of the reed 8 is of the thickness 28 which is exactly equal to the longitudinal dimension of the rectangular window 6. In addition this portion 11 is formed with a throughgoing cylindrical hole 13 of a diameter D that is centered on an axis that is perpendicular to the portion 11. At its end remote from the vibrating portion 9 the mounting portion 11 is formed with two oppositely directed square tabs 26 and 27 of a width 30 measured parallel to the symmetry line 15 extending longitudinally through the reed 8 and perpendicular to the longitudinal direction of the plate 1. The mounting portion 11 has a dimension 25 between the tabs 26 and 27 and the portion 9 and measured parallel to the symmetry line 15 which is equal to between three and four times the dimension 30. The dimension 28 is equal to slightly less than three times the dimension 30. The portion 11 is of regular thickness T and has a pair of opposite coplanar faces.

The plate 1 is formed with a rectangular-section groove 14 extending transversely from and in line with each of the windows 6. This groove 14 has a length equal to the dimension 25 and a width equal to the dimension 28. Furthermore the groove 14 has a planar base surface 17 which lies in a plane P′ tipped at an angle 16 to the plane P defined by the upper face 23 of the plate 1. Thus the groove 14 at the edge of the window 6 has a relatively shallow depth smaller than the thickness T but further back at its remote end has a somewhat greater depth which may be equal to the thickness T.

Inside the groove 14 on the symmetry line 15 there is formed a rivet 12 centered on an axis A intersecting the center line 15 and perpendicular thereto and having a diameter D identical to the diameter D of the hole 13. The rivet 12 may even be of slightly greater diameter than the diameter D as will be described below. This rivet 12 is formed unitarily with the plate 1 in part by forming a dimple 35 on the rear face 36 of the plate 1.

As shown in FIG. 1 the plate 1 can be formed behind the notches 14 at the longitudinal edge region 5 with a longitudinally extending rectangular-section groove 33 having a base surface 34 that is coplanar with the base surface 17 of the groove 14. The edge region 5 has a transverse width 32 between this groove 33 and the closest longitudinal edge that is equal to between two and three times the dimension 30. The groove 33 has a transverse width equal exactly to the dimension 30 so that the reed 8 can be fitted into the intersecting grooves 14 and 33 and will be recessed at least partially below the surface 23 of the plate 1 in these grooves 14 and 33. In fact due to the relative inclinations of the coplanar surfaces 14 and 33 lying in the plane P′ inclined at the angle 16 to the plane P, the reed 8 may be recessed completely below the surface 23 at least at the tabs 26 and 27.

It is also possible as shown in FIG. 2 to form the plate 1 merely with recesses 66 and 67 to receive the tabs 26 and 27, respectively. The plate 1 of FIG. 2 is advantageously made by molding, whereas the groove 33 of FIG. 1 can easily be made by machining.

Figure 3:
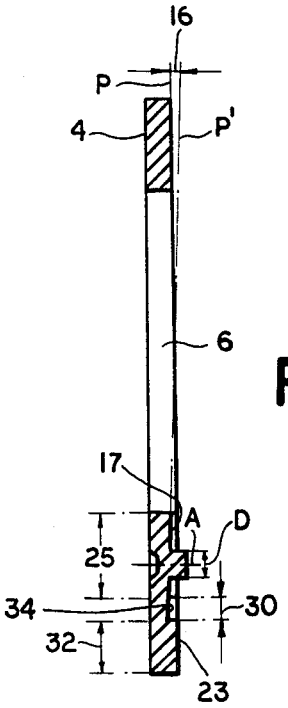
FIG. 3 is a section taken along line III—III of FIG. 2.
Figure 3A:
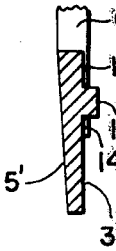
FIG. 3A is a sectional view of a detail of an alternative form of the mounting plate according to this invention.

It is also possible as shown in FIG. 3A to form the plate with an edge portion 5′ which is cut away at 37 coplanar with the base 17 of the groove 14. Such a formation makes assembly even easier, in that the rear end of the reed need not be machined exactly as it can overlap and lie on this surface 37.

In order to mount a reed 8 on a plate 1 an assembler need merely roughly position the free end portion 9 of the reed 8 to be mounted over the respective window 6 and then push the mounting portion 11 down over the rivet formation to force this rivet formation through the identically shaped hole 13. This will cause the mounting portion 11 to fit snugly in the groove 14 and cause the tabs 26 and 27 to fit snugly into the groove 33, thereby automatically perfectly aligning the portion 9 in registration over the respective window 6 with the tip 10 of the portion 9 lying at a desired spacing 22 above the plane P. This spacing 22 is a function of the angle 16 defined between the planes P and P'. Thereafter the head of the rivet 12 is upset as indicated at 18 to permanently and rigidly secure the reed 8 to the plate 1.

Such a production method therefore is relatively simple and can be carried out even by relatively unskilled personnel. The positions of the grooves 14 and 33 or of the recesses 66 and 67 ensure perfect registration of the vibrating portion 9 of the reed 8 with the window 6, leaving the exact all-around spacing of several hundredths of a millimeter that is required for best tone quality and easiest vibration of the free end portion 9. Similarly the relatively large dimension 32 of the edge portion 5 ensures that the mounting portion 11 will be securely held on a relatively massive part of the assembly, so that the generation of unwanted harmonics or other sympathetic vibration will be completely avoided.

I claim:

1. A reedboard for a reed type musical instrument, comprising:

an elongated flat reed having a free end portion and a mounting end portion both of generally the same reed width;

a reed support plate formed with a pair of transversely spaced and longtitudinally extending edge portions, a pair of longitudinally spaced and transversely extending web portions forming with said edge portions a window of a window width generally equal to said reed width, said window being adapted to receive reed-vibrating air flow therethrough, a substantially planar face defining a reed receiving surface of said support plate, and a groove formed at one of said edge portions, opening at said face, extending transversely from said window, having a groove width substantially equal to said reed width, and having a substantially planar base surface inclined away from said window to said face; and means for securing said mounting portion in said groove on said surface thereof with said free end portion in registration over said window and spaced remote from said mounting end portion above said face.

2. The combination defined in claim 1 wherein said mounting portion is provided with a tab extending longitudinally of said plate and said plate is formed with a recess snugly receiving said tab.

3. The combination defined in claim 2 wherein the distance measured transversely of said plate between said tab and said window is at least equal to the width of said tab measured transversely of said plate.

4. The combination defined in claim 3 wherein said reed is symmetrical about a centerline ending transversely of said plate and has two such tabs, said plate being formed with two such recesses each receiving a respective tab.

5. The combination defined in claim 4 wherein said means is a rivet formed integrally with said plate and extending generally perpendicularly of said face from said surface of said groove through said mounting portion.

6. The combination defined in claim 5 wherein said rivet is substantially cylindrical and has a predetermined rivet diameter, said mounting portion being formed with a substantially cylindrical throughgoing hole receiving said rivet and of a predetermined hole diameter at most equal to said rivet diameter.

7. The combination defined in claim 4 wherein said mounting plate is formed with a plurality of parallel such windows and notches, said combination further comprising a respective reed for each of said windows, said recesses being continuous and extending longitudinally the full length of said plate and receiving all of said tabs.

8. The combination defined in claim 7 wherein said plate has a pair of generally parallel longitudinal edges, said recess having a substantially planar recess base surface substantially coplanar with said base surface of said groove and extending all the way transversely of said plate from said mounting portion to the respective longitudinal edge.

9. The combination defined in claim 7 wherein said recess is a groove of regular section extending longitudinally past all of said windows.

10. The combination defined in claim 4 wherein said free end portion of said reed tapers away from said mounting portion and has a minimum width at its end remote from said mounting portion that is less than said window width and less than its width close to said mounting portion.

11. The combination defined in claim 4 wherein said recess is substantially rectangular and substantially exactly shaped to receive said tabs and the portion of said mounting portion between said tabs.

12. The combination defined in claim 4 wherein said recess has a base surface coplanar with said base surface of said groove.

13. The combination defined in claim 4 wherein said window is rectangular.

14. The combination defined in claim 4 wherein said reed is completely recessed below said face at its end remote from said free end portion.

15. The combination defined in claim 4 wherein said mounting portion is T-shaped.

* * * * *